US005661874A

United States Patent [19]

Latour

[11] Patent Number: 5,661,874

[45] Date of Patent: Sep. 2, 1997

[54] CARPET FASTENING SYSTEM

[76] Inventor: Lawrence John Latour, 825 Jackson, Thibodaux, La. 70301

[21] Appl. No.: 904,047

[22] Filed: Jun. 19, 1992

[51] Int. Cl.[6] ..... A47G 27/04

[52] U.S. Cl. ..... 16/4; 16/16

[58] Field of Search ..... 16/4, 16

[56] References Cited

U.S. PATENT DOCUMENTS

| | | | |
|---|---|---|---|
| 1,739,943 | 12/1929 | Bolender | 16/16 |
| 1,770,215 | 7/1930 | McIntyre | 16/16 |
| 3,828,391 | 8/1974 | Sutton et al. | 16/16 |
| 3,997,937 | 12/1976 | Manguso | 16/6 |
| 4,759,096 | 7/1988 | Dorris | 16/4 |
| 4,837,889 | 6/1989 | Saotome | 16/4 |

FOREIGN PATENT DOCUMENTS

| | | | |
|---|---|---|---|
| 2115692 | 9/1983 | United Kingdom | 16/4 |

*Primary Examiner*—Chuck Y. Mah

[57] ABSTRACT

A carpet fastening system in which a fastening strip 100,200 & 300) is affixed to the back-side of the wall board (10) or the wall baseboard (8), preferably with the wall engagement portion (101, 201 & 301) being substantially flat, presenting either a flat, face-to-face, extended surface interface (FIGS. 1A & 2A) with the back-side of the wall or at least preferably a continuous or at least substantially extended edge (FIG. 3A) in engagement with the back-side, bottom edge of the wall baseboard. For ease in installation, the fastening strips may be installed either at the same time as the baseboards are installed or even when the wall boards are being installed. As a result of engaging the back-side of the wall the fastening strips are firmly affixed to the wall and provide secure, strong affixation to the wall, securely anchoring the strips and hence the carpet, preventing any migration of the carpet during its typically expected life-time and longer. The embodiments are described (FIG. 1+, FIG. 2+ and FIG. 3+), each of which engage and interlock with the backside of the wall, either in a sandwich arrangement or an angled back straight edge engagement with a lip formed between the wall board and the baseboard (FIG. 3+). However, in all cases, when a force is applied to the fastening strip in a direction tending to pull it away from the wall, the force causes the movement resistance engagement of the strip to proportionately increase due to the interfacing with the back-side of the wall.

22 Claims, 4 Drawing Sheets

CARPET FASTENING SYSTEM

TECHNICAL FIELD

The present invention relates to carpet fastening systems used to fasten carpets to the floor typically along the periphery of the walls of a house, office or other building. More particularly, the present invention relates to carpet fastening members which will be used in place of the well known and typically used "tack strips." Even more particularly, the present invention is directed to a carpet fastening strip which is affixed to the wall at the back-side of the wall or the wall baseboard, rather than being affixed to the floor, and is preferably installed when, for example, the baseboards or even when the walls are installed.

BACKGROUND ART

In the prior art typically in use in the housing construction and carpet installation industries, wooden "tack strips" with nails or other sharp projections sticking up through them are used to fasten carpet to floors at the periphery edges of the wall. These tack strips have to be nailed or glued to the floor surface, which is time consuming and accordingly relatively expensive.

Additionally, in some instances the concrete surface of the floor becomes so hard that it is very difficult to nail the tack strip to the concrete. When this happens the concrete typically cracks and chips.

With respect to the prior art of the patent literature, perhaps the patent that is most relevant to the invention is the U.S. Pat. No. 4,759,096 patent to Dorris issued Jul. 26, 1988. In the Dorris approach a carpet fastening strip, which can be made of "wood, plastic, metal; flexible ceramic material, or combinations of these" materials, rather than being affixed to the floor, is hopefully held in position by segmented, laterally spaced, face board engaging portions. This face board engaging portions, which are bent under the face board, engage its underside with a series of spaced, inclined protrusions or spikes in the embodiments illustrated.

Thus, the interfacing engagements are at only a relatively few points, constituting a relatively small total area, and the holding forces involved are not directly opposed but rather are at acute angles under a spring biasing force with a force components tending to break the interconnection. Such an engagement, with its very limited, point-to-point type of engagement, is not as reliable as is desired, being susceptible to being pulled out of engagement, or to the loss of the springiness of the material, causing it to fail in its holding power.

In contrast, the embodiments of the invention (three exemplary ones are disclosed) are firmly affixed to the back-side or downwardly extending back edge of either the wall board or the base or face board of the wall, with flat, face-to-face surface engagement or at least continuous or substantially extended engagement along the upper, leading edge of the fastening strip. Indeed the more the strip is pulled, the greater the holding power becomes, while the Dorris approach has very little structural strength to overcome before it would fail.

Other patents which might be of general, background interest are the patents to Sutton (U.S. Pat. No. 3,828,391 issued Aug. 13, 1974) and the patent to Manguso (U.S. Pat. No. 3,997,937 issued Dec. 21, 1976). The latter provides anchoring means comprising a series of clips attached to each tack strip, which allows the strip to be nailed to the wall, avoiding, for example, the problem of trying to nail the wooden tack strips to a concrete floor. The former is directed to a "tackless carpet stripping" molded of plastic which is nailed to the floor.

It is believed that a number of other patents directed to carpet fastening systems and tack strips therefor can be found in Class 16, Subclass 16.

GENERAL DISCUSSION OF INVENTION

Thus the present invention is directed to a carpet fastening system in which a fastening strip is affixed to the back-side of the wall or the wall baseboard, preferably with the wall engagement portion being substantially flat, presenting either a flat, face-to-face surface interface with the back-side of the wall or at least preferably a continuous or at least substantially extended edge in engagement with the back-side, bottom edge of the wall baseboard.

For ease in installation, the fastening strips of the invention are preferably installed at the same time as the baseboards are installed or even when the wall boards are being installed.

As a result of engaging the back-side of the wall, the fastening strips are firmly affixed to the wall and provide secure, strong affixation to the wall, anchoring the strips and hence the carpet, preventing any migration of the carpet during its typically expected life-time and longer.

In a first, exemplary embodiment the wall engaging portion of the fastening strip is basically "L" shaped in its side, cross-sectional configuration, with the stem of the "L" being inserted behind, for example, the wall board (made e.g. of sheetrock) and the base of the "L" forming a bridging portion to carpeting engaging portion of the strip. In a second, exemplary embodiment the wall engaging portion forms (in a sense) two, stacked "L's", with the stem of the top "L" placed behind, for example, the baseboard and the horizontally extending stem of the top "L" engaging the underside of the bottom of the baseboard.

These first two, exemplary embodiments both provide a flat, extended surface, face-to-face, surface engagement with the back-side of the wall, either by being in such contact with the back-side of the wall board (1st embodiment) or the back-side of the wall baseboard. The second embodiment further provides a base for ease in relatively positioning the wall engaging portion of the fastening strip correctly with the baseboard.

In a third, exemplary embodiment the wall engaging portion is likewise preferably flat but only engages the back-side of the lower edge of the baseboard with preferably a continuous straight-line edge engagement.

However in all cases, when a force is applied to the fastening strip in a direction to provide a tendency to pull it away from the wall, the force causes the movement resistance engagement of the strip to proportionately increase due to its extended, straight-line or flat, face-to-face interfacing with the back-side of the wall.

The invention preferably provides a carpet fastener for attaching a carpet to a wall, with or without a baseboard, without needing to use nails or glue. Additionally, it is contemplated that the present invention will eliminate the problems that are prevalent with the prior art.

The use of the invention is expected to save valuable time and be less trouble to install than the systems of the prior art. Additionally, the system of the invention provides significant advantages, inter alia, in replacing damaged carpet caused by flooding and the like.

It is therefore an object of the present invention to provide a securely anchored carpet fastening strip which uses an affixing engagement of the strip with the back-side of the wall, either the wall board or the baseboard, preferably avoiding the need to nail or otherwise directly affix the fastening strip to the floor.

It is another object of the present invention to preferably provide such engagement using a substantially flat, wall engaging member, providing either a flat, face-to-face surface engagement or a continuous or at least substantially extended, straight edge engagement with the back-side of the wall.

It is a further object of the invention to provide a carpet installation and fastening system which will save time and be less costly and yet provide a more secure and reliable anchoring system for the carpet, particularly at its peripheral edges with the walls of a house, office or other building.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a perspective, partially cut-away view of a first, exemplary embodiment of the over-all carpet fastening system of the present invention, in which the wall engaging portion of the fastening strip interfaces with the back-side of the bottom part of the wall board and is sandwiched between it and a "two by four" plate, with the carpet and its backing fasten in position under the anchoring action of the fastening strip; while

FIG. 2 is a perspective, partially cut-away view of a second, exemplary embodiment of the over-all carpet fastening system of the present invention, in which the wall engaging portion of the fastening strip interfaces with the back-side of the bottom part of the wall baseboard and is sandwiched between it and the wall board, with the carpet and its backing fasten in position under the anchoring action of the fastening strip; while

FIG. 3 is a perspective, partially cut-away view of a third, exemplary embodiment of the over-all carpet fastening system of the present invention, in which the wall engaging portion of the fastening strip interfaces with the back-side of the bottom part of the wall baseboard and provides a straight edge engagement with the back-side of the baseboard, with the carpet and its backing fasten in position under the anchoring action of the fastening strip; while

MODES FOR CARRYING OUT THE INVENTION

Figure 1:
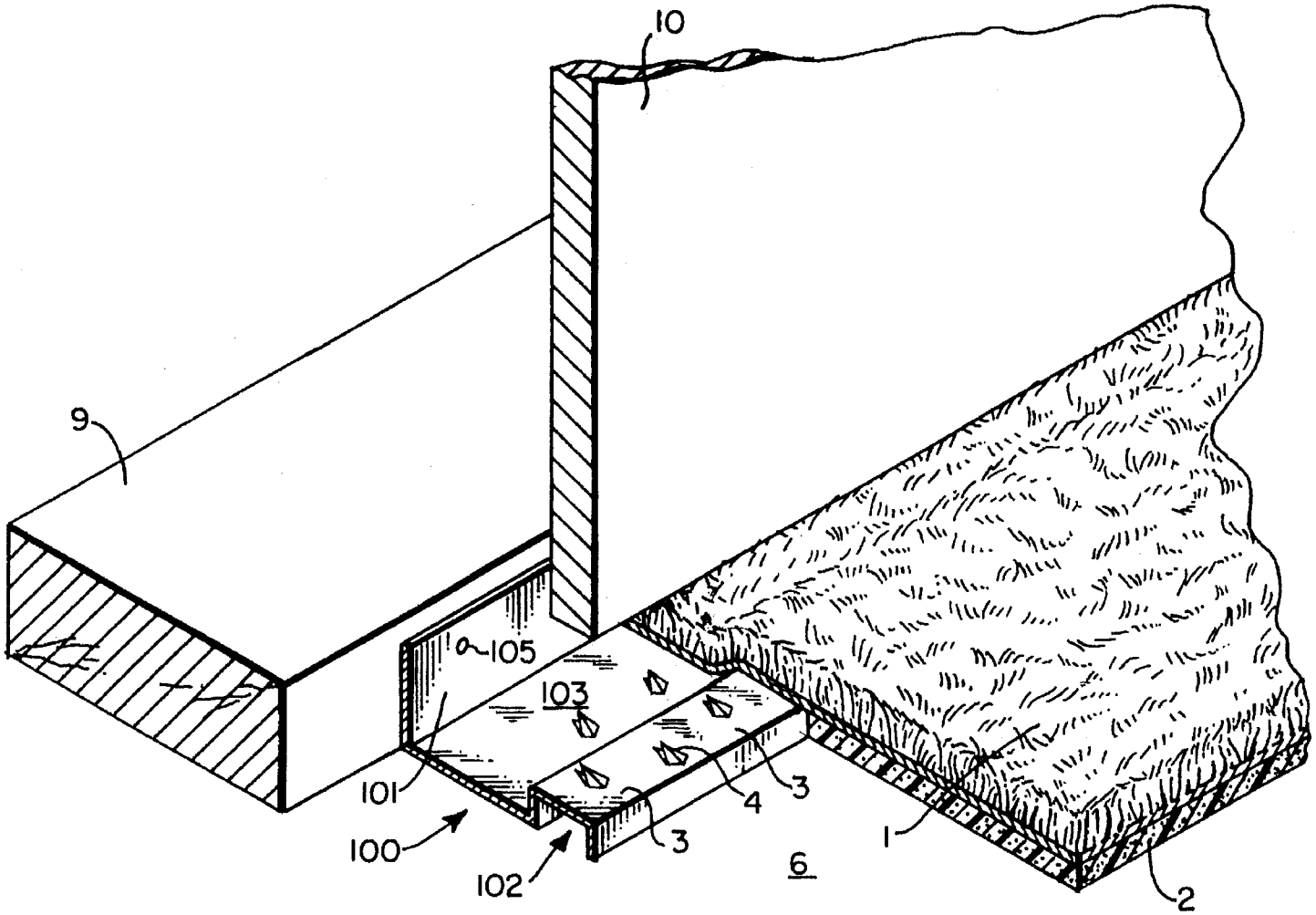

1st Embodiment (FIG. 1+)

Figure 1A:
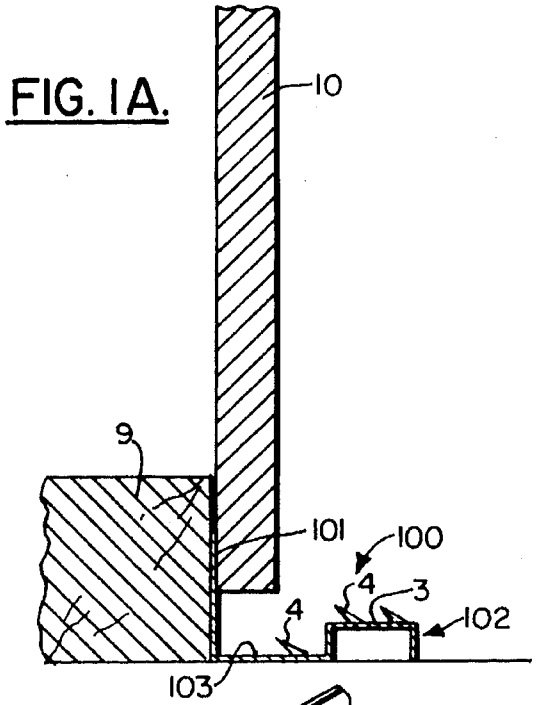
FIGS. 1A & 1B are side and perspective views, respectively, of the embodiment of FIG. 1, with the former including the wall and the latter showing only the fastening strip itself.
Figure 1B:
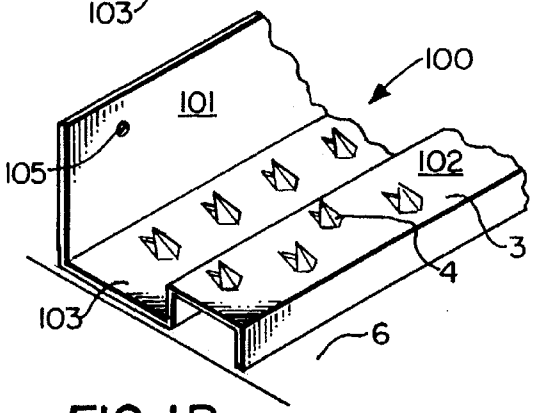

As can be seen in FIGS. 1 and 1A & 1B the initial, exemplary embodiment of the over-all carpet fastening system of the present invention includes a first exemplary embodiment of the fastening strip 100 in which there are three portions, a wall engaging portion 101, a carpet securing, base portion 102 and a bridging portion 103 between them, all integrally formed together out of, for example, a single piece of bent sheet metal. Of course the fastening strip could be made of other materials, such as, for example, a molded or extruded material or be made of other formed materials.

As can be clearly seen in the figures, the wall engaging portion 101 engages in flat, face-to-face, extended surface engagement the back-side of the wall board 10, which can be, for example, drywall or sheet rock (e.g. ½" thickness). As a result the wall engaging portion is actually sandwiched between the wall board 10 and the exemplary "2×4 " wood floor plate 9, which is usually secured to the floor 6 usually by nailing. This causes the fastening strip 100 to be securely affixed and anchored to the wall.

As a result the carpet 1 and its underlayment backing 2 is securely held and anchored in place along the periphery of the floor or where ever the anchoring strip 100 is placed, which in the illustrated design would typically be placed along the wall parallel to it with the wall engaging portion juxtaposed to the wall and outboard of the carpet securing, base portion 102. The carpet securing, base portion 102 preferably is raised with respect to the bridging portion 103, forming a plateau with respect to it and having preferably an inverted, squared-off "U" shape in its side configuration (note particularly FIG. 1A).

At least the carpet securing, base portion 102 includes a series of spaced spikes 4 which protrude up and stick into the underside of the backing 2 and carpet 1, holding them in place. However, the bridging portion 103, as illustrated, likewise includes some spikes 4 piercingly engaging the underside of the backing and carpet. It is noted that the sides of the spikes 4 preferably form the bases of intersecting triangular surfaces meeting at a common vertex. This design provides, not only significant carpet piercing capability, but also has great strength in contrast to those of the prior art which typically includes only a single stamped out, relatively flat panel.

As shown in the drawings, a series of nail holes 105 are included along the width or lateral extent of the wall engaging portion 101 to allow the fastening strip 100 to be preliminarily attached or "tacked" to the base plate 9, while awaiting for the addition and nailing of the wall board 10 to the base plate to complete up the "sandwich" arrangement illustrated in FIG. 1A.

This embodiment thus can be installed with the installation of the wall plates 9, i.e., well before the wall baseboards, or preferably in conjunction with the installation of the wall baseboards 8.

The other two, exemplary embodiment, are described below. However, for the sake of brevity, because many of of elements are the same (in which case identical reference numbers are used) or analogously the same (in which case analogous reference numbers are used), a description of all of them will not be provide, as such would merely be redundant.

Figure 2A:
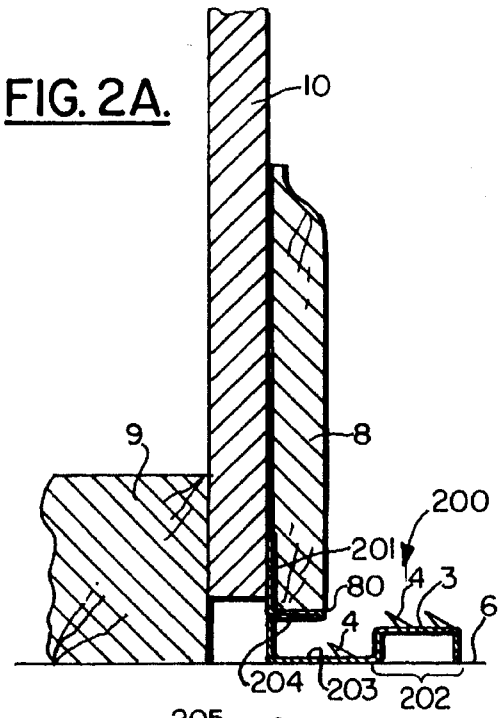
FIGS. 2A & 2B are side and perspective views, respectively, of the embodiment of FIG. 2, with the former including the wall and the latter showing only the fastening strip itself.
Figure 2B:
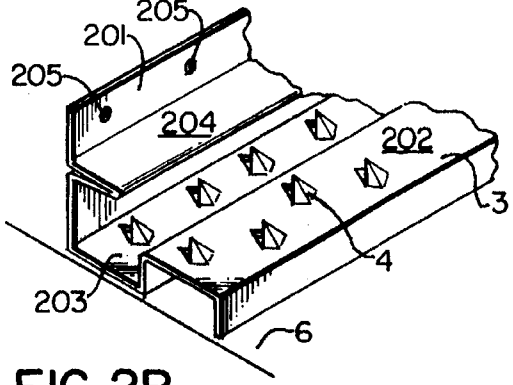
Figure 2:
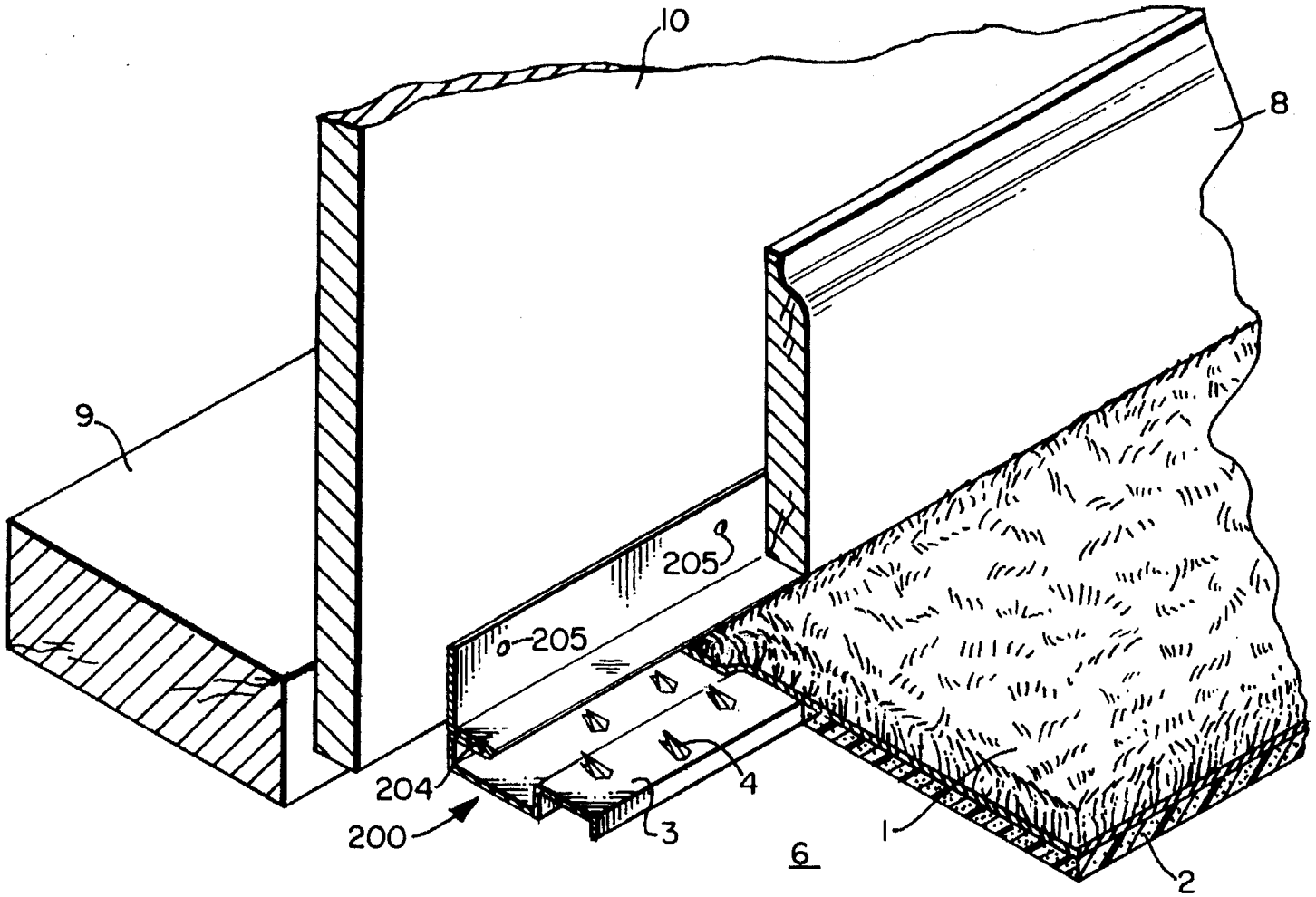

2nd Embodiment (FIG. 2+)

As can be seen in FIGS. 2 and 2A & 2B, a second, exemplary embodiment of the over-all carpet fastening system of the present invention includes a second exemplary embodiment of the fastening strip 200 in which there are three portions, a wall engaging portion 201, a carpet securing, base portion 202 and a bridging portion 203 between them, all integrally formed together.

The second, exemplary embodiment 200 of the fastening strip is very similar to the first embodiment 100, both in structure and in installation and use. However, one very significant difference is that the strip 200 includes an alignment and positioning gauge 204, which makes installation of the strip easier and eases the installation of the baseboard 8. Once the strip 200 has been preliminarily fastened or affixed to the wall board 10, the baseboard installer needs only to place the bottom or underside 80 of the baseboard on top of the horizontal platform provided by the gauge 204.

The platform or base gauge 204 is formed in the strip by merely including a horizontal fold-back during the bending or other forming of the strip 200. In essence, the inclusion of the fold or gauge 204 forms a double, stacked "L ", one nested in the other, with the base of the upper "L" being formed by the gauge or platform 204, while the base of the lower, larger "L" is formed by the bridging portion 203.

Again, analogously to the first embodiment as described above, although not shown in the drawings, a series of nail holes could be included along the width or lateral extent of the wall engaging portion 201 to allow the fastening strip 200 to be preliminarily attached or "tacked" to the wall board 10, while awaiting for the addition and nailing of the wall baseboard 8 to the wall board to complete up the "sandwich" illustrated in FIG. 2A, which of course is different than that of FIG. 1A.

Figure 3A:
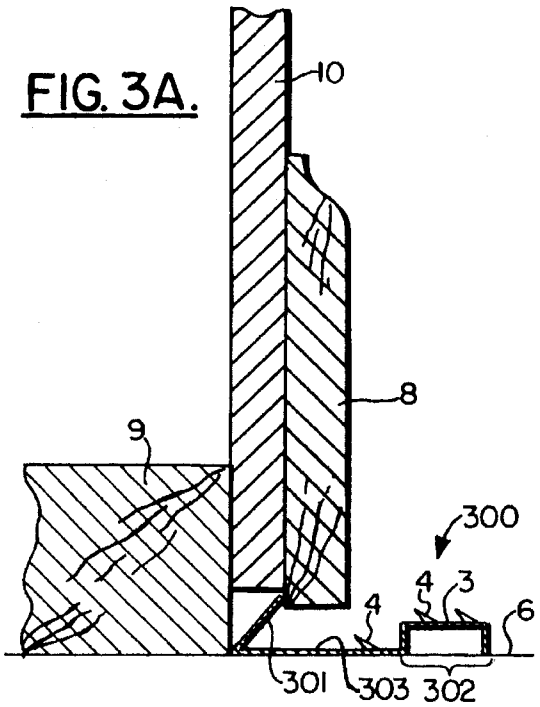
FIGS. 3A & 3B are side and perspective views, respectively, of the embodiment of FIG. 3, with the former including the wall and the latter showing only the fastening strip itself.
Figure 3B:
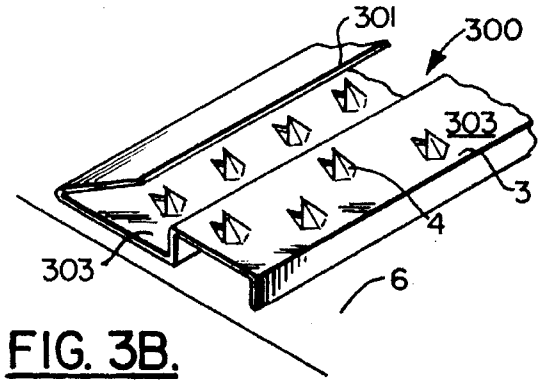
Figure 3:
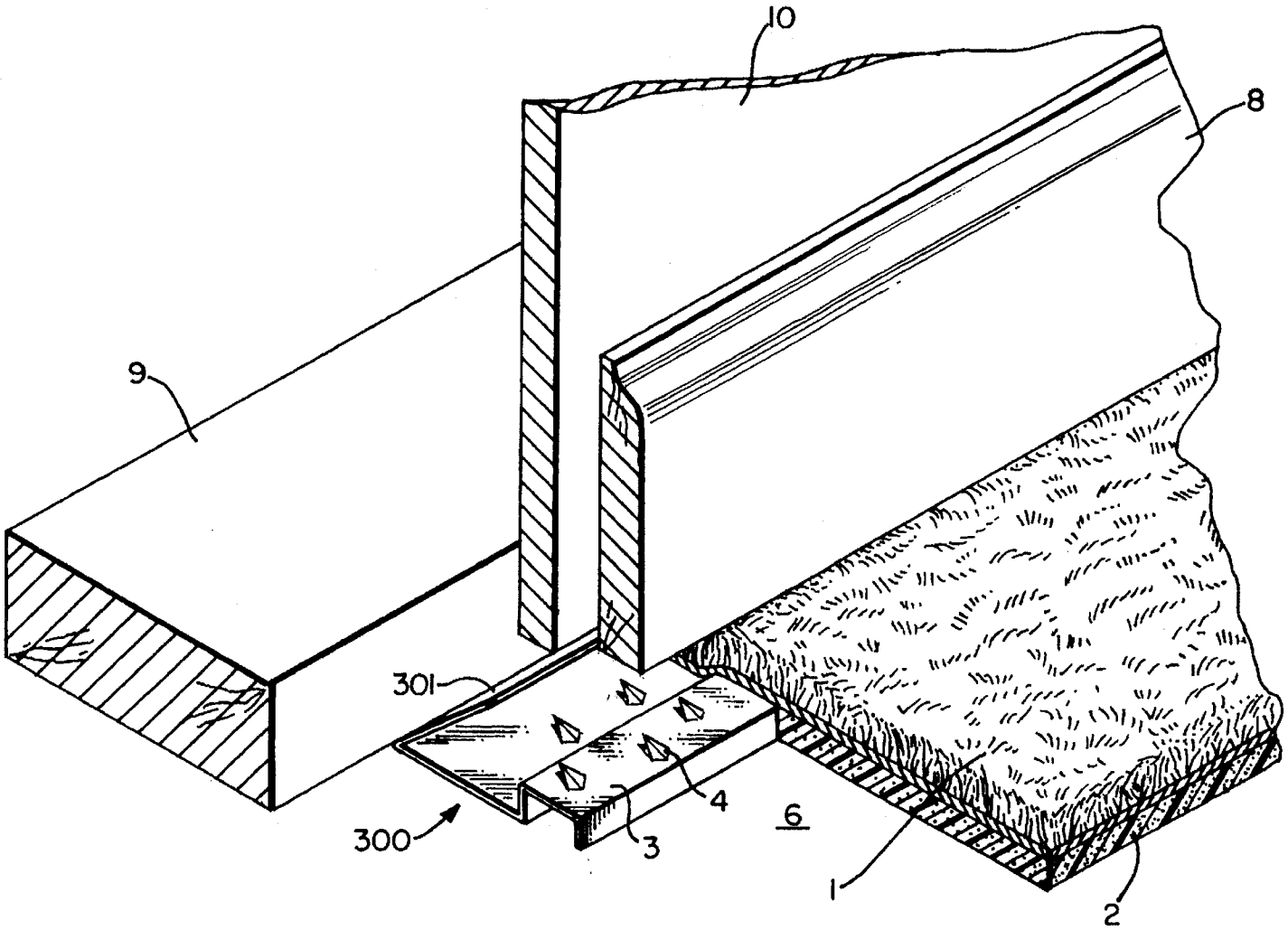

3rd Embodiment (FIG. 3+)

As can be seen in FIGS. 3 and 3A & 3B, a third, exemplary embodiment of the over-all carpet fastening system of the present invention includes a third exemplary embodiment of the fastening strip 300 in which there are three portions, a wall engaging portion 301, a carpet securing, base portion 302 and a bridging portion 303 between them, all integrally formed together.

With respect to its carpet securing, base portion 302 and its bridging portion 303, it is substantively identical to the other two embodiments. However, its wall engaging portion 301 is bent back over the bridging portion 302 at an angle of about forty-five (45) degrees (note particularly FIG. 3A).

This allows its terminal edge to lockingly fit into the edge or lip formed between the intersection of the bottom, outer edge of the wall board 10 and the bottom, inner edge of the baseboard 8, which extends further lower down than the wall board. The combination thus preferably forms a continuous (at least extended) straight-edge to straight-edge interfacing engagement. This forms a far stronger affixing of the strip 300 to the wall than achieved, for example, by the Dorris approach of the '096 patent.

It is noted that the three embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

I claim:

1. A carpet fastening system for securing carpet about the periphery of a floor adjacent to a wall made up of a wall board having a front side, and a baseboard having a back side and a bottom underside, which baseboard is separately fastened on the front side of the wall board after the wall board has been installed, said carpet fastening system comprising:

a base portion having a series of protrusions engageable with and extendable into the underside of the carpet and capable of holding the carpet in position on the floor;

a flat, wall engaging portion affixed to said base portion and being positionable outboard of and above said base portion in juxtaposition to and in contact with the front side of the wall board and capable of affixing said base portion and said wall engaging portion to the Wall board of the wall, while said base portion holds the carpet in place on the floor; and a bridging portion between said wall engaging portion and said base portion, said flat, wall engaging portion also including a substantially flat, horizontal component spaced up from and extending over said bridging portion forming a self-supporting platform capable of interfacing with the bottom underside of the baseboard before the baseboard is fastened to the wall board, said flat, wall engaging portion being located above said horizontal component forming said platform, said base portion, said bridging portion, said horizontal component, and said flat, wall engaging portion being made of a single, unitary, strip of material, with the exterior edge of the strip first forming said base portion, an intermediate, immediately adjacent part of said strip forming said bridging portion with a vertically extending portion, which then extends out into said horizontal component and then up above said horizontal component into said flat, wall engaging portion, with said flat, wall engaging portion ultimately being positionable between the front side of the wall board and the back side of the baseboard after the baseboard is attached on the wall board.

2. The carpet fastening system of claim 1 wherein said bridging portion being flat and engageable on its underside in face-to-face surface interfacing with the upper surface of the floor.

3. The carpet fastening system of claim 2, wherein:

said base portion has an upper surface providing a raised plateau at a higher vertical level than said bridging portion.

4. The carpet fastening system of claim 3, wherein:

said plateau of said base portion forms an inverted "U" in its side, cross-sectional configuration.

5. The carpet fastening system of claim 1 wherein:

said flat wall engaging portion extends substantially vertically up from said bridging portion, presenting an extended area interfacing with the back-side of the wall.

6. The carpet fastening system of claim 1, wherein:

said bridging portion is substantially flat with a series of upwardly extending pointed protrusions which can pierce the underside of the carpet.

7. The carpet fastening system of claim 1, wherein said of protrusions comprise:

a set of at least two sides forming the bases of two intersecting triangular surfaces meeting at a common vertex.

8. The carpet fastening system of claim 7, wherein said protrusions are stamped out integrally from the material of said base portion.

9. A carpet fastening system for securing carpet about the periphery of a floor adjacent to a wall having a back side and including a baseboard which also has a back side, said carpet fasting system comprising:

a base portion having a series of protrusions engageable with and extendable into the underside of the carpet and capable of holding the carpet in position on the floor;

a wall engaging portion affixed to said base portion and being positionable outboard of said base portion in juxtaposition to the wall and having a wall engaging member engageable with the back side of the baseboard and capable of affixing said base portion and said wall engaging portion to the back side of the baseboard, while said base portion holds the carpet in place on the floor; and a bridging portion between said wall engaging portion and said base portion, said wall engaging portion extending up from said bridging portion and extending back at an acute angle over said bridging portion, presenting a straight, extended edge interfacing with a portion of the back-side of the baseboard.

10. The carpet fastening system of claim 9, wherein the wall includes a wall board with the baseboard fastened to said wall board forming an intersection between them with the baseboard extending further down than said wall board forming a rearwardly facing lip between them, and wherein:

said extended edge of said wall engaging portion lockingly fits into the lip formed by the intersection of the wall board and the baseboard.

11. A carpet fastening system securing carpet about the periphery of a floor adjacent to a wall, wherein the wall includes a wall board and a baseboard having a back side and a flat bottom underside, comprising:

a floor having an upper surface;

a carpet laid out on the floor;

a wall board extending up from the floor and having a front side toward the carpet; and a carpet fastening strip, including a base portion having a series of protrusions engageable with and extendable into the underside of the carpet and capable of holding the carpet in position on the floor;

a wall engaging portion affixed to said base portion and being positioned outboard of said base portion in juxtaposition to the front side of the wall board and having a flat, wall engaging portion engageable with the front side of the wall board and capable of affixing said base portion and said wall engaging portion to the front side of the wall board, while said base portion holds the carpet in place on the floor; and a bridging portion between said flat, wall engaging portion and said base portion, said bridging portion being flat and being engaged on its underside in a face-to-face surface interfacing with the upper surface of the floor, said base portion having an upper surface providing a raised plateau at a higher vertical level than said bridging portion; said flat, wall engaging portion extending substantially vertically up from said bridging portion presenting a face-to-face, extended area interface with the front side of the wall board; said flat, wall engaging portion also including a horizontal component located above said bridging portion and extending over said bridging portion and having a substantially flat top forming an interfacing support platform interfacing with the bottom underside of the baseboard, the flat bottom of the underside of the baseboard located on said flat top and interfaced against said flat top of said horizontal, component.

12. The carpet fastening system of claim 11, wherein:

said plateau of said base portion forms an inverted "U" in its side, cross-sections configuration.

13. The carpet fastening system of claim 11, wherein:

said bridging portion is substantially flat with a series of upwardly extending pointed protrusions which can pierce the underside of the carpet.

14. The carpet fastening system of claim 11, wherein:

said base portion, said wall engaging portion and said bridging portion are integrally formed from a substantially flat piece of sheet material folded to form said base portion in the configuration of a squared, inverted "U" configuration with a horizontal flat top, to form said wall engaging portion to be substantially flat, and to form said bridging portion to be substantially flat and horizontal.

15. The carpet fastening system of claim 14, wherein said series of protrusion comprise:

a set of at least two sides forming the bases of two intersecting triangular surfaces meeting at a common vertex, and said series of protrusions are stamped out integrally from the flat material of said top of said base portion.

16. The carpet fastening system of claim 11, wherein said flat wall engaging portion further includes:

a series of laterally spaced nail holes with nails through them fastening the fastening strip to said base plate.

17. The carpet fastening system of claim 11 wherein:

said base portion, said bridging portion, said horizontal component, and said wall engaging portion are made of a single strip of bent, sheet metal, with the exterior edge of the strip first forming said base portion, an intermediate, immediately adjacent part forming said bridging portion with a vertically extending portion, which then goes into said horizontal component, which is bent back unto itself forming said support platform having a double wall thickness of said sheet metal.

18. The carpet fastening system of claim 17, wherein:

after said bent sheet metal is folded back unto itself, said bent sheet metal then extends again vertically upwardly with a flat, vertical surface forming said wall engaging portion with said flat vertical surface being sandwiched between the front side of the wall board and the back side of the baseboard.

19. A carpet fastening system securing carpet about the periphery of a floor adjacent to a wall, comprising:

a floor having an upper surface;

a carpet laid out on the floor;

a wall extending up from the floor and having a back side away from the carpet; and a carpet fastening strip, including a base portion having a series of protrusions engageable with and extendable into the underside of the carpet and capable of holding the carpet in position on the floor;

a wall engaging portion affixed to said base portion and being positioned outboard of said base portion in juxtaposition to the wall and having a flat, wall engaging portion engageable with the back side of the wall and capable of affixing said base portion and said wall engaging portion to the back side of the wall, while said base portion holds the carpet in place on the floor; and a bridging portion between said flat, wall engaging portion and said base portion, said bridging portion being flat and being engaged on its underside in a face-to-face surface interfacing with the upper surface of the floor, said base portion having an upper surface providing a raised plateau at a higher vertical level than said bridging portion; said flat wall extending up from said bridging portion and extending back at an acute angle over said bridging portion presenting a straight, extended edge interface with the back side of the wall.

20. The carpet fastening system of claim 19, wherein said wall includes a wall board and a baseboard fastened to said wall board forming an intersection between them with the baseboard extending further down than said wall board forming a lip, and wherein:

said edge interface of said flat wall lockingly fits into the edge formed between the lip formed by the intersection of the wall board and the baseboard.

21. A method of securing carpet about the periphery of a floor adjacent to a wall using a fastening strip having a carpet engaging portion, wherein the wall includes initially a well board and subsequently a baseboard which is ultimately attached to the bottom portion of the wall board, comprising the following steps:

a) using a fastening strip having a base portion, a wall engaging portion and a bridging portion between them, with said wall engaging portion further having a horizontally extending, support platform extending over and spaced vertically up from said bridging portion, and a vertically extended, substantially flat part;

b) positioning and engaging said substantially flat part of the fastening strip to the front of the wall board, and affixing the fastening strip in place;

c) thereafter placing the bottom of the baseboard on top of and down against the top surface of said horizontal support platform and against the front of the wall board, using said top surface to position and support said baseboard as it is attached to the bottom portion of the wall board; and d) using said carpet engaging portion to hold the carpet in place, preventing it from moving about with respect to the floor.

22. The method of claim 21, wherein said flat portion is located above the support platform, and wherein there is included in step "c" the following step:

sandwiching said flat portion of the fastening strip between the front side of the wall board and the back side of the baseboard while attaching said baseboard to the bottom portion of the wall board, effectively attaching the baseboard said flat portion and the wall board all together, with said flat portion being sandwiched between the wall board and the baseboard.

* * * * *